US005975304A

United States Patent [19]

Cain et al.

[11] Patent Number: 5,975,304

[45] Date of Patent: Nov. 2, 1999

[54] SEALED CONTAINERS WITH TABS AND METHOD OF MAKING THE SAME

[75] Inventors: R. Michael Cain, Lancaster, Pa.; Joseph Smelko, Aurora, Canada

[73] Assignee: Unipac Corporation, Aurora, Canada

[21] Appl. No.: 09/139,461

[22] Filed: Aug. 25, 1998

[51] Int. Cl.[6] ..... B65D 1/34

[52] U.S. Cl. ..... 206/467; 206/484.2

[58] Field of Search ..... 206/461, 467, 206/469, 470, 532, 484, 484.1, 484.2; 493/52, 56

[56] References Cited

U.S. PATENT DOCUMENTS

| | | | |
|---|---|---|---|
| 4,771,935 | 9/1988 | Hekal | 206/484.2 |
| 5,393,032 | 2/1995 | Cederroth | 206/484.2 |

*Primary Examiner*—Jacob K. Ackun
*Attorney, Agent, or Firm*—Dechert Price & Rhoads

[57] ABSTRACT

Provided are a container comprising a tabbed sealing unit, blister pack containers comprising such sealing units, and methods of making such sealing units and containers.

30 Claims, 4 Drawing Sheets

SEALED CONTAINERS WITH TABS AND METHOD OF MAKING THE SAME

FIELD OF THE INVENTION

The present invention relates to sealed containers formed of one or more storage units and a corresponding number of sealing units with tabs, and methods for making such containers.

A wide variety of sealed containers such as bottles and blister packs are being developed for safekeeping of food, medicines, research supplies and so on. To open the container, the seal is generally broken by the end user by applying sufficient force to overcome the sealing force or by tearing off with suitable implements. It is sometimes laborious to remove the sealing structures and the problems are further compounded by concerns for safety, contamination or damage to the contents. Solutions have been proposed to address these and related problems by providing pull or peel tabs mostly to the innerseals of capped bottles, but not for seals of blister packs, for example. Seals bonded to the neck of the bottles are sometimes referred to in the art as innerseals.

U.S. Pat. No. 5,004,111 discloses an innerseal construction with an integral top tab. The top tab allows the end user to grasp the tab to remove the innerseal. International Application Number PCT/US93/00774 discloses peelable container seal which includes a circular tab layer joined to a circular seal layer. The tab layer allows peeling action by the consumer. U.S. Pat. No. 5,197,618 is concerned with a multilayered tamperevident pull-tab seals for container closures. U.S. Pat. No. 5,265,745 sets forth a multilayer innerseal with a grip tab which may be grasped by the consumer to remove a portion of the innerseal and that further provides evidence of tampering. U.S. Pat. No. 5,514,442 discloses a tabbed sealing member suitable for bonding to the neck of a bottle. U.S. Pat. No. 5,469,968 concerns with blister pack with a multilayered covering providing child-proof packaging structure.

As suggested by these patents, the seals may be made of multilayers, typically including one or more foil layers which are bonded together and to the opening of the container. Also as suggested by these patents, a common technique for sealing the multilayered sealing structures to the opening of the container is by induction heating. A number of problems are encountered with this sort of technique. Induction heating depends upon generation of electric currents to heat a foil layer for short duration thereby melting heat sensitive layers in the multilayered structure. The presence of additional structures such as tabs and caps on the bottles affects melting of the layers and can result in improper sealing.

In the context of blister packs, the presence of multilayered sealing members exhibit several undesirable limitations. For example, with respect to the sealing structure disclosed in U.S. Pat. No. 5,469,968, it is laborious to engage and peel away a corner or edge of each of the upper layers to delaminate it from the lower layers. The problems may be further aggravated where there is a variation in binding strengths of each layer. This results in unnecessary delay and difficulty in disconnecting the sealing structure.

Accordingly, what is desired is sealing members with tabs particularly on blister packs which can be readily removed by the end user. The tab profile should facilitate ready removal of the sealing members from the containers, while ensuring compliance with safety, manufacturing and other concerns. It should be capable of being produced simply and economically on available machinery, without numerous complex operations. Ideally induction heating is omitted and sealing is achieved rather by conduction heating or by use of pressure or solvent activated adhesive media. In addition, it is desirable to provide containers such as blister packs which can be manufactured at a lower cost and in an environmentally friendly way generating less waste than the prior art blister packs.

For the foregoing reasons, there is a need for container seals that are readily removable yet capable of providing tight seals. The present invention addresses the problems of the above prior art seals particularly in the context of blister packs by providing inexpensive and efficient container seals with tab portions.

SUMMARY OF THE INVENTION

In one embodiment, the present invention provides a container having one or more tab portions, where the container comprises one or more detachable sealing units and a corresponding number of storage units, each storage unit comprising an essentially planar shoulder portion surrounding a recessed portion. In particular, each sealing unit comprises (a) a membrane layer with a top surface and a bottom surface detachably adhered to the shoulder portion, with the top surface having a first portion and a second portion adjacent thereto; (b) a non-laminable layer; and (c) a tab stock with a bonding surface suitable for bonding to the membrane layer and to the non-laminable layer. Preferably, the non-laminable layer is situated above the first portion of the top surface of the membrane layer, and the tab stock is bound to both the second portion of the top surface of the membrane and to the non-laminable layer, such that the non-laminable layer and the tab stock bound thereto form a tab portion. The membrane layer comprises an atmospheric barrier layer.

In another embodiment the container of the present invention comprises one or more pairs of adjacent storage units and sealing units sharing a common edge between adjacent units in a pair, such that, in each pair of adjacent units, said membrane layer of one unit is continuous with said membrane layer of an adjacent unit, said non-laminable layer of one unit is continuous with said non-laminable layer of an adjacent unit, and said tab stock of one unit is continuous with said tab stock of an adjacent unit, and said adjacent storage units and sealing units are perforated at said common edge.

In addition, the present invention provides methods to manufacture such containers comprising the steps of (1) providing a membrane layer with a top surface and a bottom surface that can be detachably adhered to said shoulder portion, said top surface having a first portion and a second portion; (2) placing a non-laminable layer immediately above the first portion of said top surface of said membrane layer; (3) providing a tab stock with a bonding surface suitable for bonding to said membrane layer and said non-laminable layer; (4) bonding said tab stock to the second portion of said top surface of said membrane layer and to said non-laminable layer thereby forming said sealing unit; and (5) affixing said sealing unit to the shoulder portion of said storage unit; wherein, said non-laminable layer and said tab stock bound thereto together form a said tab portion.

DEFINITIONS

The following terms shall have, for the purposes of this application, the meaning set forth below. In particular, for the purpose of interpreting the claims, the stated definitions shall control over any assertion of a contrary meaning based on other text found herein:

laminated unit—compressed or firmly united layers of the same or different materials.

atmospheric barrier—a film, layer, membrane or other means which retards the migration of gases and moisture at least from outside to inside a sealed container, which gases and moisture may disadvantageously react with the contents of the sealed container.

DETAILED DESCRIPTION OF THE INVENTION

Figure 1:
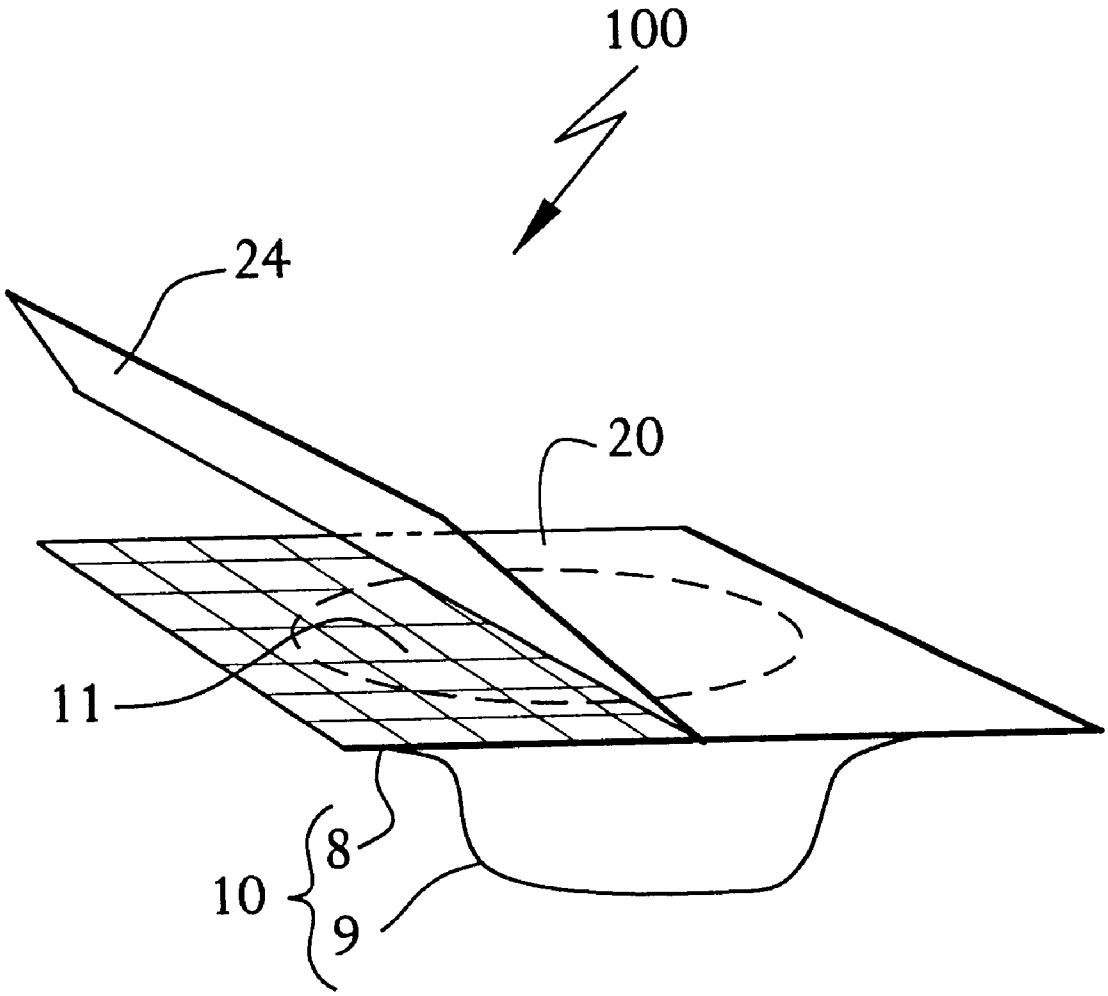
FIG. 1 a perspective view of a first embodiment.

In FIG. 1 is shown a perspective view of a container 100 of the present invention. The container 100 has a storage unit 10 and a sealing unit 20. The sealing unit 20 has an easily graspable tab portion 24. The storage unit has a recessed portion 9 and an essentially planar shoulder portion 8 surrounding the opening 11 of the storage unit.

Figure 2A:
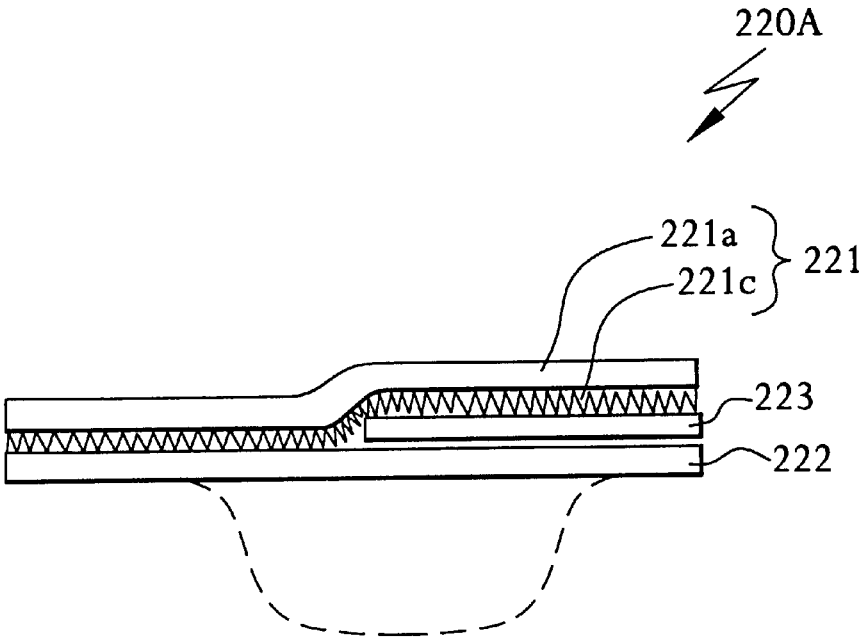
FIG. 2A is a schematic cross-sectional view of a sealing unit in accordance with one preferred embodiment of the present invention.
Figure 2B:
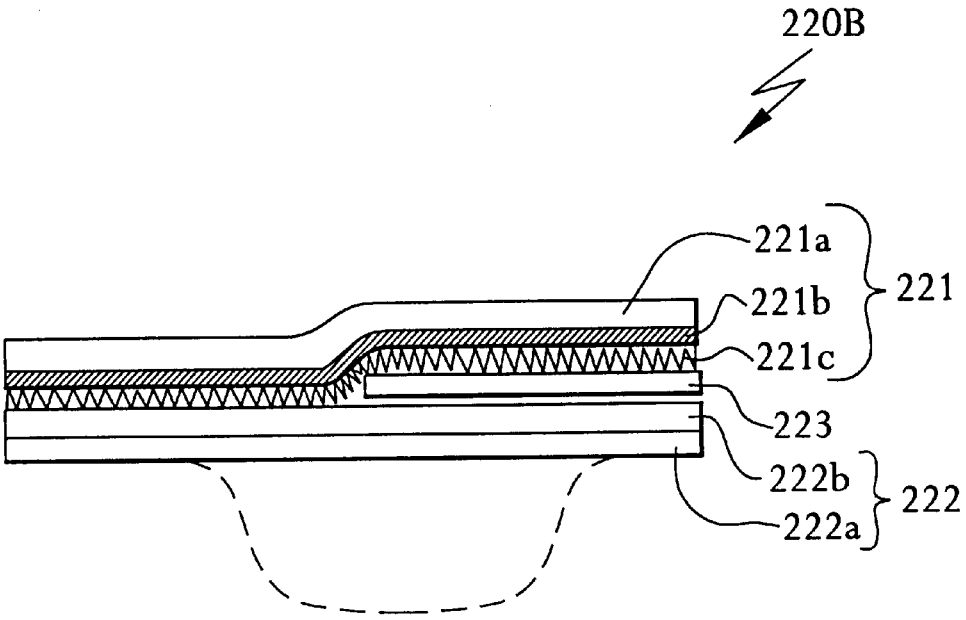
FIG. 2B is a schematic cross-sectional view of a sealing unit in accordance with another preferred embodiment of the present invention.

FIGS. 2A and 2B illustrate a schematic cross-sectional representations of sealing unit in preferred embodiments. FIG. 2A shows structural layers of sealing unit 220A in one preferred embodiment. FIG. 2B shows different structural layers of sealing unit 220B in another preferred embodiment. Shown also in these figures is the storage unit 10, with a shoulder portion 8 and a recessed portion 9, indicated as a broken line.

Referring to FIG. 2A, the sealing unit 220A has the following construction of layers. There is a membrane layer 222 with two surfaces, a top surface and a bottom surface. There is a non-laminable layer 223 on the top surface of the membrane layer 222 but extending across only a portion of the top surface. This portion of the top surface can be designated as a first portion, leaving the remaining portion as a second portion. There is a tab stock 221 extending across the second portion of the top surface of the membrane layer 222 and the non-laminable layer 223 to form a tab portion. Preferably, the membrane layer 222 is a polymer layer. Alternatively, the membrane layer can include an atmospheric barrier layer. The atmospheric barrier layer generally has a film, foil layer, membrane or other means which retards the migration of gases and moisture at least from outside to inside a sealed container, which gases and moisture may disadvantageously react with the contents of the sealed container.

The membrane layer of the sealing unit can have an optional atmospheric barrier layer in a top surface thereof, according to another preferred embodiment shown in FIG. 2B. In this embodiment, the membrane layer 222 of the sealing unit 220B has, in addition to a polymer and/or polymer laminate layer 222*a*, an optional atmospheric barrier layer 222*b* extending across and forming the top surface of the membrane layer 222. The optional atmospheric barrier layer 222*b* is suitably adhered to the polymer layer 222*a*. The non-laminable layer 223 is placed over a first portion of the top surface of the membrane layer 222 (above the atmospheric barrier layer 222*b*). A part of the tab stock 221 is bonded to the membrane layer 222 (the atmospheric barrier layer 222*b*) and the other part of the tab stock is bonded to the non-laminable layer 223 to form a tab portion. The optional atmospheric barrier layer 222*b* can be a metal foil layer to provide sufficient impermeability to moisture and gases. However, it should be noted that the invention does not require the optional atmospheric barrier layer 222*b* and the layer of the membrane layer 222 itself may confer adequate atmospheric barrier properties. For example, layer 222 can be made up of polymeric materials such as ethylene vinyl alcohol copolymer (EVOH). As described above, an atmospheric barrier layer should be impermeable to moisture and gases.

It should be appreciated from the above described sealing units that in some embodiments, the membrane layer 222 can be a single layer such as a polymer layer having a thickness from about 1 mil to about 3 mils. In some other embodiments, the membrane layer 222 can be a single layer of an atmospheric barrier layer having a thickness from about 0.5 mils to about 2 mils. In still some other embodiments, the membrane layer 222 can include both a polymer layer and an atmospheric barrier layer in any combination. The preferred polymer is a polyethylene terephthalate ("PET") or polyvinyl chloride ("PVC"). A preferred foil layer is aluminum. The tab stock 221 is preferably a heat and tear resistant reinforcing layer 221*a* with a heat sensitive adhesive film 221*c* to form a bonding surface. In some embodiments, the tab stock 221 can have a rip stop 221*b*, an additional layer between the reinforcing layer 221*a* and the adhesive film 221*c* as shown in FIG. 2B. Preferably, the reinforcing layer 221*a* is PET. The rip stop is preferably made of biaxially oriented polymer material, for example, high density polyethylene ("HDPE") or polypropylene. Preferably the adhesive film 221*c* is an EVOH polymer having about 12 to about 28 [volume/weight] percent EVOH; more preferably, the adhesive polymer has 24–28% EVOH; still more preferably approximately 28% EVOH. Depending on the application, it is within the ability of the skilled practitioner to determine the appropriate EVOH content in the adhesive layer.

In practicing the invention, the tab stock 221 can be supplied as one unitary sheet of a reinforcing layer 221*a* coupled to a heat-sensitive film 221*c*. GBC Film Products, Inc., Chicago, Ill., is one commercial source of tab stocks and of tab stocks with a rip stop layer for use in the present invention. A suitable rip stop material includes OHD (oriented high density) material available from Mobil Oil Corporation, Arlington, Va. When a suitable temperature is applied to the tab stock, the bonding surface of the tab stock facilitates bonding of the tab stock to the contacting layers underneath. The term "bond" is used herein to indicate a sufficiently strong attachment that cannot be readily reversed.

The gap between the non-laminable layer 223 and the membrane layer 222 in FIGS. 2A or 2B indicates a non-laminable region. The non-laminable layer 223 can be any suitable material that can withstand the manufacturing process conditions and not become laminated to the first portion of the membrane layer 222. Preferred suitable materials for the non-laminable layer 223 include polyethylene terephthalate, paper or other heat resistant coating or layer.

As discussed above, when the tab stock 221 is bonded to the other layers of the sealing unit, only a part of the tab stock is bonded to the second portion of the membrane layer 222. The other part is bonded to the non-laminable layer 223. That part of the tab stock 221 that is bonded to the membrane layer 222 portion remains essentially planar and the part of the tab stock 221 that is bonded to the non-laminable layer 223 together with the non-laminable layer which forms a tab portion can also be planar or can project out of the plane of the planar tab stock depending on the thickness of the non-laminable layer 223 in the sealing unit. The tab portion can be grasped by a user and pulled away to separate the sealing unit from the storage unit.

While the embodiment of FIGS. 2A and 2B shows a tab stock 221 extending cross a second portion of the top surface of the membrane layer 222 and the entire non-laminable layer 223 to form a tab portion, it is to be appreciated that many variations of this configuration are possible. One such variation is to introduce plane correction feature. Thus, an additional laminable layer such as a polymer layer can be placed on the top surface of the membrane layer 222 but on the portion adjacent to the non-laminable layer 223. When such an additional laminable layer is used, the thickness of this additional layer and the non-laminable layer should be the same such that the tab stock that is bonded to these layers remains essentially planar. This embodiment may be useful, for example, when it is desirable to apply even pressure across the surface of the sealing unit, for example, to make a strong sealing bond to the storage unit.

In one embodiment, the invention has a further additional thin layer between the sealing layer and the opening of the blister pack, such that after removal of the sealing layer, the thin layer remains in place to prevent the contents from falling out and/or to prevent contaminants from falling in, until that thin layer is broken. The additional thin layer is an easily pierced layer; i.e., the contents of the container can be pushed through it, or it can be broken by a blunt object such as a finger tip or the like. This thin layer may be formed of paper, a mesh of natural fiber or synthetic polymer, foil of thickness 1 mil or less, or other suitable material.

It should be understood that the materials described with particular reference to each layer are intended to be illustrative rather than limiting, and other materials are also contemplated.

The bottom surface of the membrane layer 222 of the sealing units 220A and 220B can be adapted to detachably affix to the shoulder portion of the storage unit (shown as broken lines in FIGS. 2A and 2B). The attachment of the membrane layer 222 to the storage unit can be achieved by a number of ways such as by applying adhesives, resins or solvents. For example, the bottom surface of the membrane layer or the shoulder portion can be coated with an adhesive. The adhesive can be a heat activated adhesive or pressure activated adhesive or solvent activated adhesive or a combination thereof. The terms "adhere," "attach" and "affix" are used to indicate an attachment that can be reversed by a simple act of pulling away.

Figure 3A:
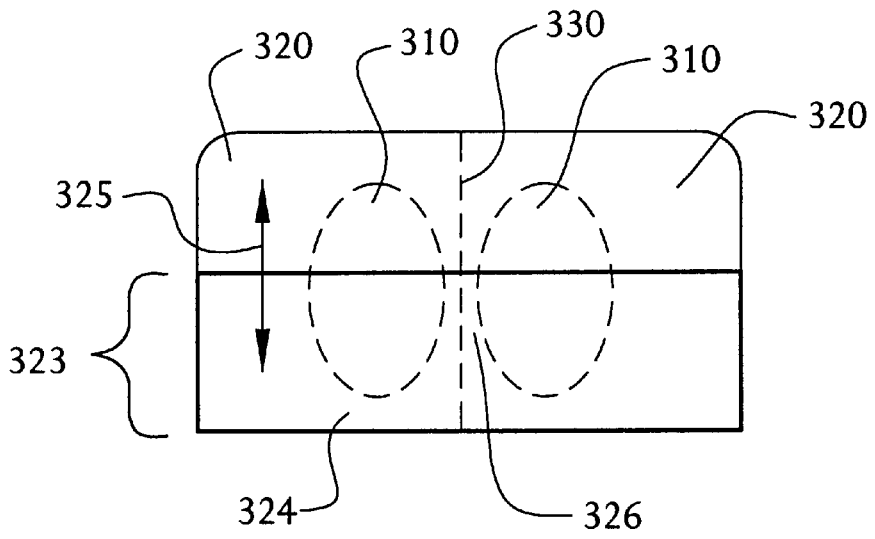
FIGS. 3A-3B are a schematic top view of a second embodiment with pairs of adjacent sealing units storage units.
Figure 3B:
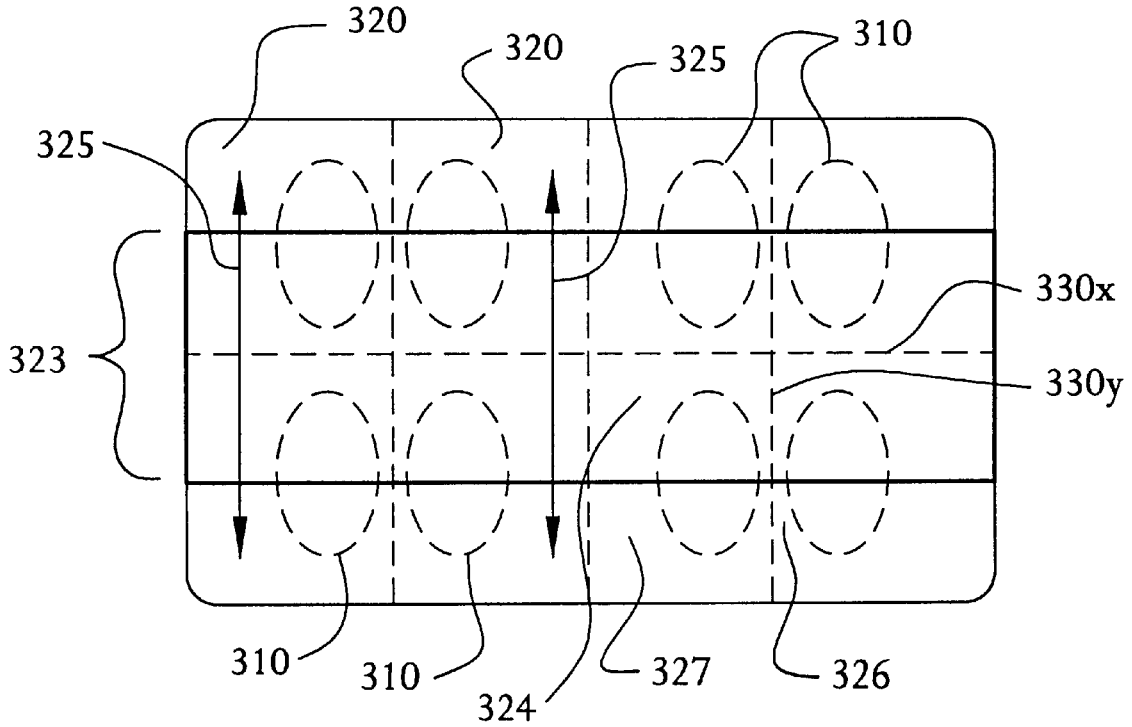

FIGS. 3A and 3B show a schematic top view of a container with pairs of adjacent storage units 310 and sealing units 320. These adjacent units share a common edge 326 such that a shoulder portion of adjacent storage units are continuous with each other and the corresponding sealing units are also continuous with each other. Within the sealing units a membrane layer of one unit is continuous with the membrane layer of an adjacent unit, a non-laminable layer of one unit is continuous with the non-laminable layer of an adjacent unit and a tab stock of one unit is continuous with the tab stock of an adjacent unit.

In embodiments with a pair of adjacent units as shown in FIG. 3A, perforations 330 are made at the common edge 326 to facilitate separation of adjacent units and opening of individual storage units in an adjacent part by pulling away the tab portion. In embodiments with plurality of adjacent pairs of units (depicted in FIG. 3B), the adjacent units of a pair share a common edge 326 as described above. In addition, either one or both of the units of a pair share a common junction 327 with the adjacent one or both units of another pair. In such embodiments, perforations are made both at common edges and at common junctions, and in two directions perpendicular to each other, or at a suitable desired angle, thereby forming x-direction perforations 330*x* and y-direction perforations 330*y*. Such perforations facilitate the formation of individual tab portions where each storage unit 310 can be opened by pulling the tab portion without disrupting or opening adjacent units simultaneously. Also shown in FIGS. 3A and 3B is the tab portion 324 that includes the tab stock 325 and the non-laminable layer 323 of the sealing unit 320.

Figure 3C:
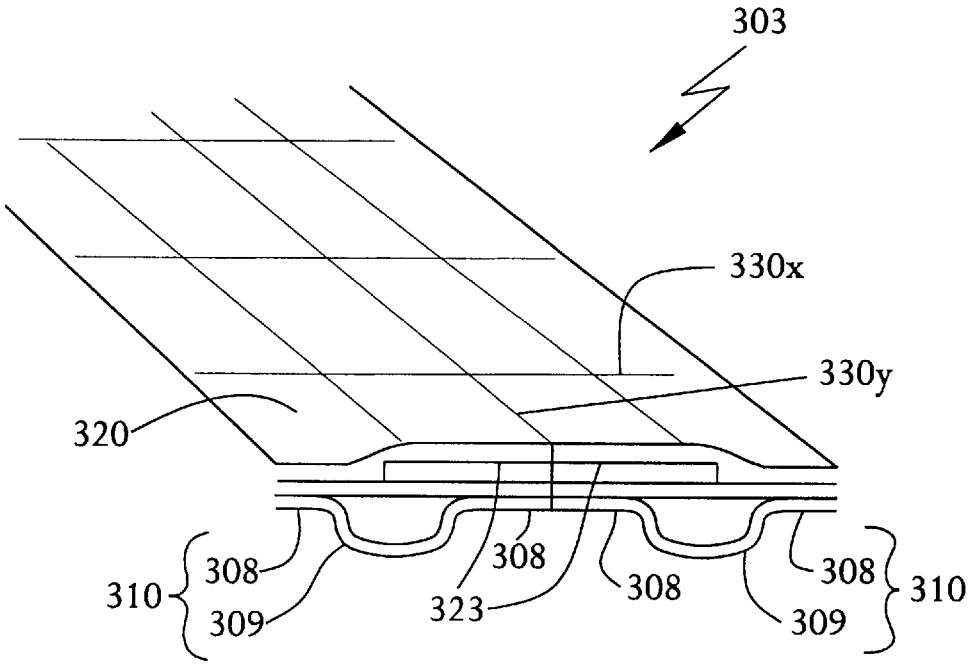
FIG. 3C is a cross sectional perspective view of a second embodiment of the present invention.

Illustrated in FIG. 3C is a cross sectional perspective view of an embodiment 303 with plurality of units. For the sake of simplicity, only one of the adjacent pairs of units on each side is shown in FIG. 3C. In this Figure, it can be seen that only the portion of the tab stock 325 occupied by the non-laminable layer 323 remains unbound to the membrane layer of the sealing unit 320. When the sealing unit 320 is detachably affixed to the shoulder portions 308, the recessed portions of the storage units 310 are sealed at the openings. The perforations 330*x* and 330*y* made either before or after the sealing unit 320 is adhered to the storage unit 310 result in the formation of individual tabs for each unit in the region occupied by the non-laminable layer 323.

In a simplest version, there are x-direction and y-direction perforations described above that are made perpendicular to each other or at a desired angle to release individual tab portions. However, in some cases, additional perforations can also be made in other directions so as to allow the end user to more easily locate and grasp the tab portion to open the container. Because the tab stock portion that is bonded to the non-laminable layer can have a tendency to project out of the plane of the tab stock portion that is bonded to the membrane layer either before or after the perforations are made (see FIG. 3C), it would be easier for the user to locate and grasp the individual tab portions that are formed after the perforations are made. Alternatively, the entire tab stock that is bonded to the layers underneath as described previously can remain essentially planar until the portions at the perforations are tampered to release tab portions. Additionally, suitable markings may be made to indicate tab portions. Further, it is to be appreciated that the plane correction feature described previously can be used with respect to the embodiment shown in FIGS. 3A–3C.

It should be noted that the shapes and sizes of the storage units and sealing units depicted in any of the illustrations of the present specification are for illustrative purposes only.

The invention is described above in the context of an overall structure of a container with storage units and sealing units. One use of the present invention is in medicament-filled containers such as blister packs. Blister packs typically have a thermoformed blister layer and a covering structure. The blister layer has a generally planar portion and areas where blisters are formed through a molding process. However, it should be recognized that the invention comprehends both the sealing units by themselves and the sealing units in combination with recessed storage units. In other words, the present invention provides for one or more sealing units each with a tab portion to cover a wide variety of storage units. In practice such sealing units could be manufactured by arranging elongate strips in the order shown in FIGS. 2A and 2B and forming a unitary sheet with tab portions by conventional techniques such as conduction heating.

The present invention also relates to a method of forming a container having one more sealing units each with a tab portion and a corresponding number of storage units. The different structural layers of a sealing unit for the container of the present invention are generally as described in the previous embodiments, particularly as in FIGS. 2A and 2B. In practice, the different layers in the form of long sheets may be placed one above the other in the appropriate order and be laminated together to form a single laminated unit. In accordance with the present invention, the method of forming a container with one or more storage units and a corresponding number of detachable sealing units each with a tab portion is essentially as follows. First a membrane layer such as a polymer layer is provided. Then a suitable non-laminable layer is placed on the top surface of the membrane layer. In some embodiments, an optional atmospheric barrier layer is placed first on the top surface of the polymer layer together forming of membrane layer. If the optional atmospheric barrier layer is used, it is typically a metallic foil layer such as aluminum. Then a suitable non-laminable layer is placed on the top surface of the atmospheric barrier layer of the membrane layer. In either case, the relative size of the non-laminable layer is such that it only occupies a portion of the top surface and does not cover the entire surface. A tab stock with a lower bonding surface is provided to form the uppermost layer of the sealing unit. The tab stock is preferably a reinforcing layer with an adhesive film on one surface which forms the bonding surface. The size of the tab stock is such that when it is used as uppermost layer of the sealing unit the bonding surface not only extends across the entire surface of the laminable layer but also the remaining portion of the top surface of the membrane layer or the atmospheric barrier layer as the case may be. It is also desirable that the different layers of the sealing unit are coextensive with each other (except the non-laminable layer) to minimize waste and to increase the handling efficiency during manufacture. It should be appreciated that the size of the non-laminable layer in the method of the present invention should be sufficient to form a suitably graspable tab portion.

The different layers described above are laminated together to form a sealing unit by any suitable technique known in the art, such as, for example, conduction heating. Conduction heating typically involves direct heating of the material by contact. Preferably, conduction heating is coupled with pressure applied downwardly from the top of the tab stock. As the tab stock is in direct contact with a heating block during conduction heating, it is necessary to choose a particularly suitable material. The reinforcing layer of the tab stock is preferably sufficiently thick, and made of material with strength and melt characteristics, to withstand heat due to conduction heating. The heat activated adhesive film of the bonding surface is able to cause bonding to the membrane layer when appropriate temperature and pressure are applied.

The bottom surface of the membrane layer of the sealing unit is detachably affixed to the shoulder portion of the storage unit to form a sealed container. Sufficient adherence of the membrane layer to the shoulder portion can be achieved by providing various adhering agents. The bottom surface of the membrane layer or the shoulder portion can be coated with resins or heat- or pressure-sensitive adhesives. Alternatively, solvents can also be used as adhering agents. In such cases it would be desirable that both the membrane layer and the shoulder portion of the storage unit have compatible chemistries. The sealing of the sealing unit on the storage unit thus achieved ensures a protective environment for the container contents while providing the useful tab portion.

Consistent with the above discussion, the method also encompasses forming a container with plurality of storage units with corresponding sealing units. In practicing the invention, the spatial arrangement of the thermoformed recessed portions of the storage units on a sheet material depends on the type of mold being used. For example, in forming adjacent storage units, the planar shoulder portion joining adjacent recessed portions can be reduced to a common edge as in pairs of adjacent storage units. Alternatively, the planar shoulder portion joining adjacent recessed portions can be larger than a common edge thereby forming a common junction. The storage units thus formed on the sheet can be covered with a backing such as the sealing unit made according to the method described above. After the container is formed, with a plurality of adjacent storage units in pairs and corresponding sealing units sharing a common edge, perforations are made at the common edge. Perforations are also made at the common junctions to form individual tab portion for each individual unit.

The common junctions can also be subjected to die-cutting so that pairs of units in the form of long strips or blocks can be separated from each other. The shape of the die and the depth of the die-cut can be adjusted during the process.

The present invention is further supported by the following non-limiting example.

EXAMPLE

Figure 4:
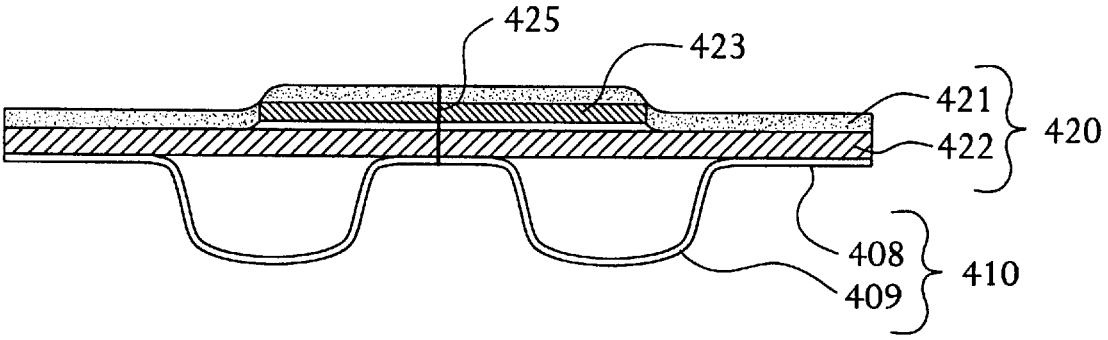
FIG. 4 is an example of a sealed container shown in cross sectional view.

A sealed container with plurality of storage units and sealing units with tabs was constructed according to the method detailed previously. The container construction may be described by referring to FIG. 4. First, a three-layer sealing unit 420 was constructed to form a roll of sealing unit material 40" wide and approximately 1000' in length. For this roll, a 40" wide 1 mil thick aluminum foil obtained from Reynolds Aluminum, Richmond, Va., was provided as the membrane layer 422. On the top surface of the membrane layer 422, ten (10) 1" wide strips of 0.5 mil thick polyester material obtained from GBC Film Products, Inc., Chicago, Ill., were placed longitudinally as non-laminable layers 423 with 3" between each strip. Then, a 40" wide 0.5 mil thick PET material obtained from GBC Film Products, Inc. with a film of heat-melt material on one surface was placed as the topmost layer 421. The multilayer composite was laminated to form one single laminated unit by conduction heating. During conduction heating a metallic block heated to a preset temperature was placed on the topmost layer 421 to compress the layers of the construction under heat and pressure. This material was then cut into 4" wide rolls for use by packagers such as pharmaceutical manufacturers.

For the manufacture of the finished blister package, the 4" wide roll of sealing unit material was fed into a conventional packaging machine, such as the Formpack machine from Bosch GmbH., Vineland, N.J. In this machine, each unit of the assembly of blister pack storage units 410 from VPI Mirrex Corp., Sailsbury, Md., was filled with the item to be held in the finished container, and the assembly of filled storage units was run through the machine so that the roll of sealing unit material 420 was seated on the storage units 410 in a continuous process. The sealing unit material 420 was bonded to the shoulder portions 408 of the storage units 409 by conduction heating to activate adhesive on the lower surface of the foil layer 422 of the sealing unit. The strip of sealed units was then die cut to form packagable units 3⅞" by 4¼" in size, comprising 4×6 individual sealed, filled storage units. In the die cutting process, perforations 425 were also made at the borders between the individual units, including along the longitudinal center line of non-laminable portion 423 of the sealing unit (thereby making the tab portions accessible). The sealed containers with tabs produced in accordance with this example were all proven to be successful.

While this invention has been described with an emphasis upon a preferred embodiment, it will be obvious to those of ordinary skill in the art that variations in the preferred composition and method may be used and that it is intended that the invention may be practiced otherwise than as specifically described herein. Accordingly, this invention includes all modifications encompassed within the spirit and scope of the invention as defined by the following claims.

What is claimed is:

1. A container having one or more tab portion, said container comprising one or more detachable sealing units and a corresponding number of storage units, each storage unit comprising an essentially planar shoulder portion surrounding a recessed portion, and each sealing unit comprising:

(a) a membrane layer with a top surface and a bottom surface detachably adhered to said shoulder portion, said top surface having a first portion and a second portion adjacent thereto;

(b) a non-laminable layer; and (c) a tab stock with a bonding surface suitable for bonding to said membrane layer and to said non-laminable layer;

wherein, said non-laminable layer is situated above said first portion of said top surface of said membrane layer, and said tab stock is bound to said second portion of said top surface of said membrane and to said non-laminable layer, such that said non-laminable layer and said tab stock bound thereto form a tab portion.

2. The container of claim 1 wherein said membrane layer comprises an atmospheric barrier layer.

3. The container of claim 1 comprising one or more pairs of adjacent storage units and sealing units sharing a common edge between adjacent units in a pair, such that, in each pair of adjacent units, said membrane layer of one unit is continuous with said membrane layer of an adjacent unit, said non-laminable layer of one unit is continuous with said non-laminable layer of an adjacent unit, and said tab stock of one unit is continuous with said tab stock of an adjacent unit, and said adjacent storage units and sealing units are perforated at said common edge.

4. The container of claim 3 comprising two or more pairs of adjacent storage units and sealing units, wherein said storage units and said sealing units are perforated at each edge between adjacent storage units and sealing units.

5. The container of claim 1, wherein said container is a blister pack.

6. The container of claim 1, wherein said membrane layer comprises a polymer.

7. The container of claim 6, wherein said polymer comprises polyethylene terephthalate or polyvinyl chloride.

8. The container of claim 1, wherein said membrane layer and said storage unit comprise an adhesive material.

9. The container of claim 8, wherein said material comprises a solvent-activated adhesive.

10. The container of claim 8, wherein said material comprises a heat-activated adhesive.

11. The container of claim 8, wherein said material comprises a pressure-activated adhesive.

12. The container of claim 1, wherein said bottom surface of said membrane layer comprises an adhesive material for affixing to said shoulder portion of said storage unit.

13. The container of claim 1, wherein said bottom surface comprises a resin material for affixing to said shoulder portion of said storage unit.

14. The container of claim 2, wherein said atmospheric barrier layer comprises a metallic foil layer.

15. The container of claim 14, wherein said metallic foil layer comprises aluminum.

16. The container of claim 2, wherein said atmospheric barrier layer comprises ethylene vinyl alcohol copolymer.

17. The container of claim 1, wherein said non-laminable member comprises paper.

18. The container of claim 1, wherein said bonding surface comprises a heat-sensitive film for bonding a part of said bonding surface to said second portion of said membrane layer and another part of said bonding surface to said non-laminable layer.

19. The container of claim 18, wherein said heat-sensitive layer comprises ethylene vinyl acetate.

20. The container of claim 1, wherein said tab stock comprises a reinforcing layer.

21. The container of claim 1, wherein said tab stock comprises a heat resistant layer.

22. The container of claim 1, wherein said tab stock comprises a tear resistant layer.

23. The container of claim 1, wherein said sealing unit further comprises an additional laminable layer situated above said second portion of said top surface of said membrane layer, said additional laminable layer having substantially the same thickness as said non-laminable layer.

24. A method of forming a container having one or more tab portions, said container comprising one or more detachable sealing units and a corresponding number of storage units, each storage unit comprising by an essentially planar shoulder portion surrounding a recessed portion, the method comprising the steps of:

(a) providing a membrane layer with a top surface and a bottom surface that can be detachably adhered to said shoulder portion, said top surface having a first portion and a second portion;

(b) placing a non-laminable layer immediately above the first portion of said top surface of said membrane layer;

(c) providing a tab stock with a bonding surface suitable for bonding to said membrane layer and said non-laminable layer;

(d) bonding said tab stock to the second portion of said top surface of said membrane layer and to said non-laminable layer thereby forming said sealing unit; and (e) affixing said sealing unit to the shoulder portion of said storage unit;

wherein, said non-laminable layer and said tab stock bound thereto together form a said tab portion.

25. The method of claim 24, wherein said container is a blister pack.

26. The method of claim 24, wherein said container comprises plurality of adjacent storage units and the corresponding sealing units, wherein said adjacent units share a common junction.

27. The method of claim 24, wherein said container comprises plurality of adjacent storage units in pairs and the corresponding sealing units, wherein said adjacent units of a pair share a common edge.

28. The method of claim 26, wherein said common junction is perforated.

29. The method of claim 27, wherein said common edge is perforated.

30. The method of claim 24, further comprising placing an additional laminable layer immediately above said second portion of said top surface of said membrane layer, said additional laminable layer having substantially the same thickness as said non-laminable layer.

* * * * *